US011616297B2

(12) United States Patent
Suzuki et al.

(10) Patent No.: US 11,616,297 B2
(45) Date of Patent: Mar. 28, 2023

(54) ACTIVE PHASED ARRAY ANTENNA DEVICE AND POWER SUPPLY CONTROL METHOD

(71) Applicant: Mitsubishi Electric Corporation, Chiyoda-ku (JP)

(72) Inventors: Hiroshi Suzuki, Chiyoda-ku (JP); Keisuke Nakamura, Chiyoda-ku (JP); Yuya Matsuda, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 90 days.

(21) Appl. No.: 16/898,621

(22) Filed: Jun. 11, 2020

(65) Prior Publication Data

US 2021/0005965 A1 Jan. 7, 2021

(30) Foreign Application Priority Data

Jul. 2, 2019 (JP) ..... JP2019-123370

(51) Int. Cl.
*H01Q 3/34* (2006.01)
*H01Q 21/00* (2006.01)
*H01Q 23/00* (2006.01)

(52) U.S. Cl.
CPC ..... *H01Q 3/34* (2013.01); *H01Q 21/0025* (2013.01); *H01Q 23/00* (2013.01)

(58) Field of Classification Search
CPC ..... H01Q 3/34; H01Q 3/385; H01Q 21/0025; H01Q 23/00; H02J 1/14; H02J 1/106;
(Continued)

(56) References Cited

U.S. PATENT DOCUMENTS 4,806,937 A 2/1989 Peil
2009/0219083 A1* 9/2009 Kawasaki ..... H03K 19/0016 327/540

(Continued)

FOREIGN PATENT DOCUMENTS

EP 3547538 A1 * 10/2019 ..... H03K 17/165
JP 2758421 B2 5/1998

(Continued)

OTHER PUBLICATIONS

Japanese Office Action dated Aug. 2, 2022 in Japanese Application No. 2019-123370 with English translation, citing documents 15 and 16 therein, 9 pgs.

*Primary Examiner* — Seokjin Kim
(74) *Attorney, Agent, or Firm* — Oblon, McClelland, Maier & Neustadt, L.L.P.

(57) ABSTRACT

An active phased array antenna (APAA) device includes antenna elements, active circuits, switches, and a control circuit. The antenna elements transmit and receive radio waves. The active circuits are connected to the antenna elements and start an operation upon supply of power distributed from a power supply circuit and transmit and receive signals via the antenna elements to which the active circuits are connected. The switches are connected to the active circuits, and start, upon being closed, supply of power to the active circuits to which the switches are connected, and stop, upon being opened, the supply of power to the active circuits to which the switches are connected. The control circuit transmits to the switches switching signals to turn the switches on and off to control starting and stopping of the supply of power to the active circuits. The control circuit sets timing differences in execution timings of executing the start of the stop of supply of power to the active circuits.

13 Claims, 11 Drawing Sheets

(58) Field of Classification Search
CPC .. H02J 1/109; H02J 3/14; H02M 1/14; H02M 1/36; H02M 1/38; H02M 1/385; H04W 88/085; H04M 19/005
See application file for complete search history.

(56) References Cited

U.S. PATENT DOCUMENTS

| | | | | |
|---|---|---|---|---|
| 2011/0012881 | A1* | 1/2011 | Chang | H05B 45/46 345/211 |
| 2013/0134801 | A1* | 5/2013 | Lin | H01Q 1/50 307/126 |
| 2013/0281036 | A1* | 10/2013 | Kolokotronis | H04B 17/101 455/115.1 |
| 2016/0099686 | A1* | 4/2016 | Perreault | H04B 1/0475 330/296 |
| 2017/0094718 | A1* | 3/2017 | Chamberlain | H04M 19/005 |
| 2018/0227113 | A1* | 8/2018 | Kobayashi | H04W 52/02 |
| 2019/0357193 | A1* | 11/2019 | Bai | H04W 72/10 |
| 2020/0153268 | A1* | 5/2020 | Shinohara | H02J 9/005 |
| 2020/0201736 | A1* | 6/2020 | Nishiyama | G06F 1/28 |
| 2021/0005965 | A1* | 1/2021 | Suzuki | H01Q 3/34 |

FOREIGN PATENT DOCUMENTS

| | | |
|---|---|---|
| JP | 2008-256502 | 10/2008 |
| WO | WO 00/65651 | 11/2000 |

* cited by examiner

ACTIVE PHASED ARRAY ANTENNA DEVICE AND POWER SUPPLY CONTROL METHOD

CROSS-REFERENCE TO RELATED APPLICATION

This application claims the benefit of Japanese Patent Application No. 2019-123370, filed on Jul. 2, 2019, the entire disclosure of which is incorporated by reference herein.

FIELD

The present disclosure relates to an active phased array antenna device and a power supply control method.

BACKGROUND

An active phased array antenna device has antenna elements. The active phased array antenna device is hereinafter abbreviated as an APAA device. For example, an APAA device with active circuits including amplifiers and phase shifters distributed close to the corresponding antenna elements may distribute and supply power from a power supply circuit to these active circuits.

In the case of distribution and supply of power from a power supply circuit located at a remote location to the active circuits distributed close to the antenna elements, a distance between the power supply circuit and each active circuit tends to increase, which results in increased length of power supply wiring. The increased length of the power supply wiring may have predominant effects, such as a voltage drop due to resistive components of the power supply wiring or a transient due to reactance components. If multiple active circuits concurrently start or stop operations when the APAA device starts or stops a transmission and reception operation, a flow of an electric current through the power supply wiring changes drastically. A transient due to reactance components of the power supply wiring, a transient response characteristic of the power supply circuit, or the like in response to a drastic change in the amount of current causes ringing and distortion at the rising edge and the falling edge of the power supply voltage.

Occurrence of ringing and distortion at the rising edge of the power supply voltage may delay a start timing of the transmission and reception operation since increased time is required until the transmission and reception operation is normal and stable. Occurrence of ringing at the rising edge of the power supply voltage may cause the active circuits to momentarily receive power supply voltage out of an allowance range of the active circuit, which may damage the active circuits. Occurrence of an inrush current may require the power supply circuit to provide an instantaneous high output current, and the required output current may exceed a capacity of output current of the power supply circuit. In addition, when multiple active circuits concurrently start or stop operations at the time of start or stop of the transmission operation of the APAA device, transmission power of the whole APAA device sharply increases or decreases, which causes a phenomenon that is momentary spreading of a frequency spectrum of the transmitted wave. Spreading of the frequency spectrum of the transmitted wave can interfere with communication of another device or with another system, and thus avoiding such spreading as much as possible is desirable.

Japanese Patent No. 2758421 discloses a method for configuring a power supply system of the APAA device to suppress variations of the power supply voltage that may occur transiently at the rising edge and the falling edge of power supply to the active circuit.

Japanese Patent No. 2758421 describes a technique of suppressing variations of the power supply voltage that occurs transiently at the rising edge and the falling edge of power supply to the active circuit, mainly by effectively arranging multiple high-capacity capacitors.

Such techniques increase the size and the cost of the APAA device.

In view of the above circumstances, an objective of the present disclosure is to suppress ringing and distortion that may occur at the rising edge and the falling edge of power supply voltage at the start or the end of the transmission and reception operation, while suppressing size and cost of the APAA device that distributes and supplies power from the power supply circuit to the active circuits.

SUMMARY

An active phased array antenna device according to the present disclosure includes antenna elements, active circuits, switches, and a control circuit. The antenna elements transmit and receive radio waves. The active circuits are connected to the antenna elements and start operation upon supply of power distributed from a power supply circuit and transmit and receive signals via the antenna elements to which the active circuits are connected. The switches are connected to the active circuits, and start, upon being closed, supply of power to the active circuits to which the switches are connected, and stop, upon being opened, the supply of power to the active circuits to which the switches are connected. The control circuit 8 transmits, to the switch 3, a switching signal to turn the switch 3 on and off to control starting and stopping of the supply of power to the active circuit 2. The control circuit sets time differences in execution timings of executing the start of the stop of supply of power to the active circuits.

According to the present disclosure, in the APAA device that distributes and supplies power from the power supply circuit to the active circuits, the control circuit that controls start and end of supply of power to the active circuits sets time differences in timings of start or stop of supply of power to the active circuits, whereby current flowing through power supply wiring increases or decreases stepwise, which can suppress ringing and distortion that may occur at the rising edge and the falling edge of the power supply voltage at the start or the end of the transmission and reception operation, while suppressing size and cost of the device.

BRIEF DESCRIPTION OF THE DRAWINGS

A more complete understanding of this application can be obtained when the following detailed description is considered in conjunction with the following drawings, in which.

DETAILED DESCRIPTION

An active phased array antenna (APAA) device according to embodiments of the present disclosure is described below in detail with reference to the drawings. The same reference signs are given the same or equivalent parts through the drawings.

Embodiment 1

Figure 1:
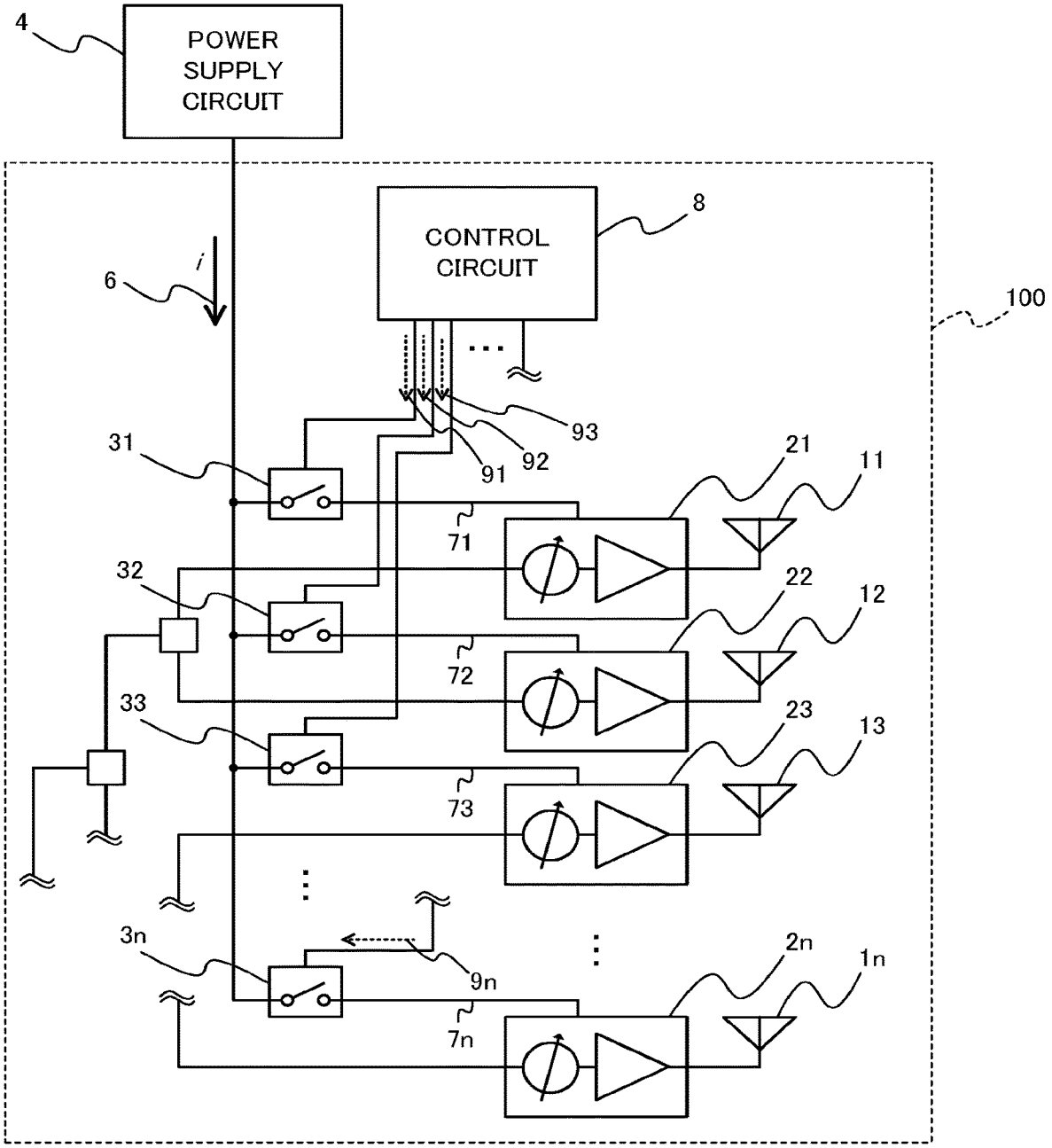
FIG. 1 is a drawing illustrating an example configuration of an APAA device according to Embodiment 1.

FIG. 1 is a drawing illustrating an example configuration of an APAA device 100 according to Embodiment 1. The APAA device 100 includes n antenna elements 11, 12, . . . , In that transmit and receive radio waves, n active circuits 21, 22, . . . , 2*n* that transmits and receive signals via the antenna elements 11, 12, . . . , In, n switches 31, 32, . . . , 3*n* that start and end supply of power from a power supply circuit 4 to the active circuits 21, 22, . . . , 2*n* by opening and closing the switches 31, 32, . . . , 3*n*, and a control circuit 8 that controls opening and closing of the switches 31, 32, . . . , 3*n*.

The antenna elements 11, 12, . . . , In may be collectively referred to as antenna elements 1. The active circuits 21, 22, . . . , 2*n* may be collectively referred to as active circuits 2. The switches 31, 32, . . . , 3*n* may be collectively referred to as switches 3.

Each active circuit 2 receives power distributed and supplied from the power supply circuit 4. The power supply circuit 4 is connected via the switches 3 to the corresponding active circuits 2 through the power supply wiring. Power supply to each active circuit 2 can be individually started and ended by closing and opening the corresponding switch 3 connected to each active circuit 2. Upon start of supply of power to the active circuit 2 after the switch 3 connected thereto is closed, the active circuit 2 starts an operation. Upon end of supply of power to the active circuit 2 after the switch 3 connected thereto is opened, the active circuit 2 stops the operation. Example operations of the active circuit 2 during a transmission operation of the APAA device 100 include an operation of phase-shifting and amplifying a signal and outputting the signal to the antenna element 1. Example operations of the active circuit 2 during a reception operation of the APAA device 100 include an operation of phase-shifting the signal received via the antenna element 1 and outputting the signal. The control circuit 8 transmits, to the switch 3, a switching signal to turn the switch 3 on and off to control starting and stopping of the supply of power to the active circuit 2. For example, the control circuit 8 constantly transmits to the switch 3 a square wave switching signal with levels "1" and "0" represented by high/low voltage. The switching signal is "1" at high voltage and "0" at low voltage. The switch 3 closes when the switching signal being received has higher voltage, that is, becomes "1". The switch 3 opens when the switching signal being received has lower voltage, that is, becomes "0".

Figure 2A:
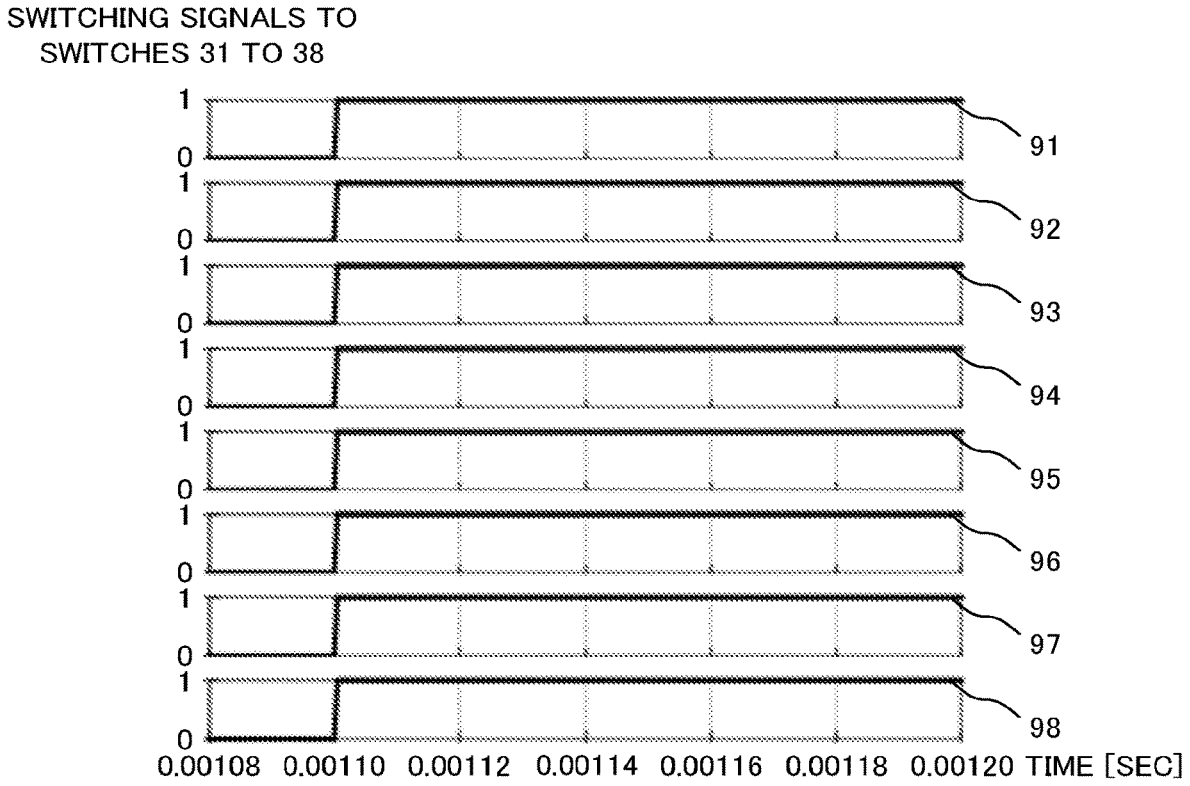
FIG. 2A is a drawing illustrating an example of a temporal change in a switching signal for each switch in a case in which switches are concurrently changed from open to closed at the same timing.
Figure 2B:
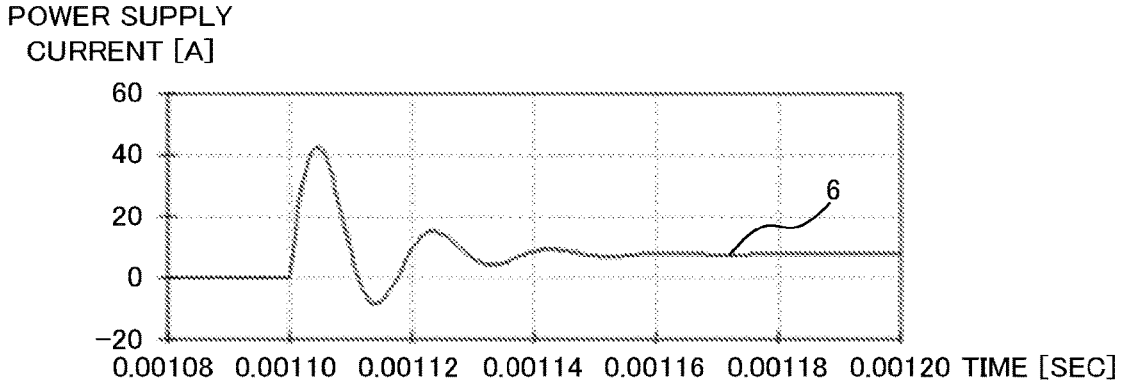
FIG. 2B is a drawing illustrating an example of a temporal change in a power supply current in a case in which the switches are concurrently changed from open to closed at the same timing.
Figure 2C:
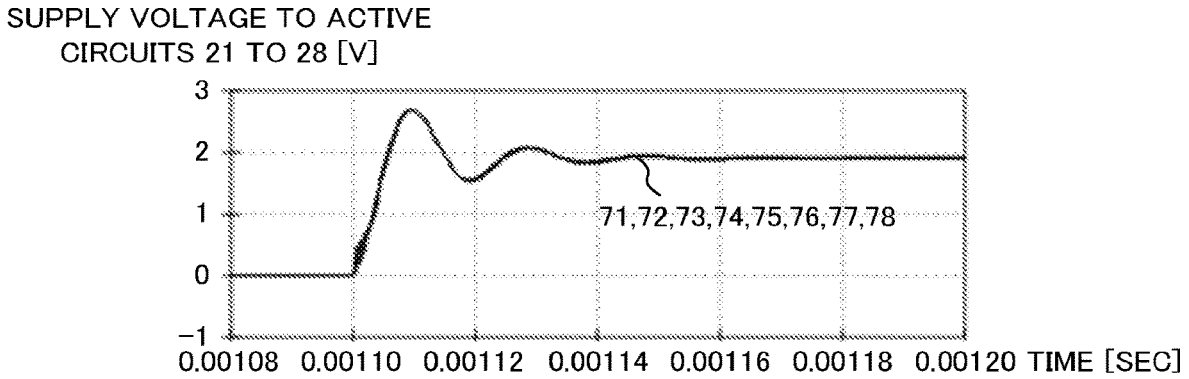
FIG. 2C is a drawing illustrating an example of a temporal change in a supply voltage to each active circuit in a case in which the switches are concurrently changed from open to closed at the same timing.

Here, a case in which a general power supply control method is applied to the APAA device 100 is described. In general, when power of the power supply circuit 4 is distributed and supplied to the active circuits 2, the switches 31, 32, . . . , 3*n* are concurrently changed from open to closed at the same timing. Temporal changes in a switching signal for each switch 3, current flowing through the power supply wiring, and a power supply voltage to each active circuit in a case in which this power supply control method is used are described with reference to FIGS. 2A, 2B, and 2C. In the examples of FIGS. 2A, 2B, and 2C, n=8. The current through the power supply wiring is hereinafter referred to as power supply current.

As illustrated in FIG. 2A, when switching signals 91 to 98 to switches 31 to 38 in closed states are concurrently changed from "0" to "1" at the same timing by the control circuit 8, active circuits 21 to 28 concurrently start operations, and as illustrated in FIG. 2B, the power supply current 6 sharply increases. A transient due to reactance components of the power supply wiring, a transient response characteristic of the power supply circuit, or the like in response to such a sharp change in the amount of current causes large ringing or distortion since voltages 71 to 78 applied to the active circuits 21 to 28 cannot follow the sharp change in the amount of current, as illustrated in FIG. 2C.

Such ringing and distortion of the power supply voltage may cause problems in that start timings of the transmission and reception operations are delayed, the active circuit 2 is damaged, a capacity of output current of the power supply circuit 4 is exceeded, and a frequency spectrum of the transmitted wave of the APAA device 100 momentarily broadens.

Particularly, when the APAA device is applied to communications requiring frequent starting and stopping of the transmission and reception operation, such as communications of a time division multiple access (TDMA) scheme or a time division duplex (TDD) scheme, ringing and distortion occurring at the rising edge and the falling edge of the power supply voltage may be a problem.

Figure 3A:
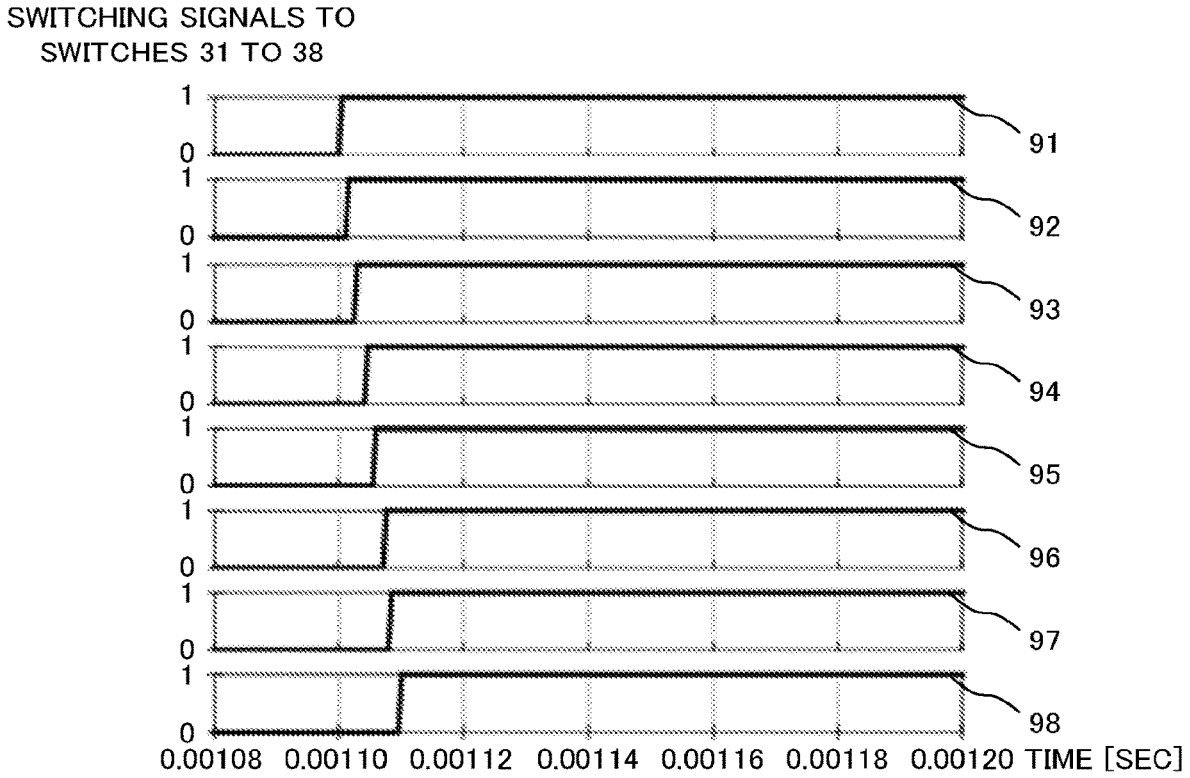
FIG. 3A is a drawing illustrating an example of a temporal change in the switching signal for each switch in a case in which a power supply control method for the APAA device according to Embodiment 1 is used.
Figure 3B:
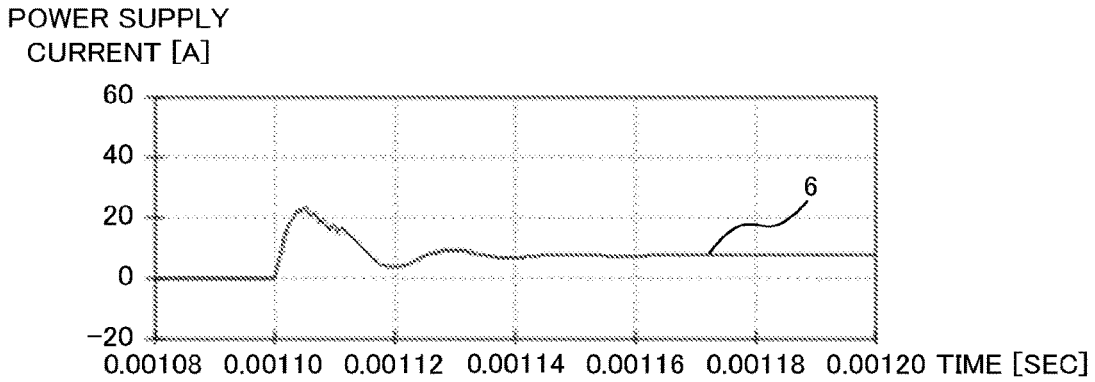
FIG. 3B is a drawing illustrating an example of a temporal change in a power supply current in a case in which the power supply control method for the APAA device according to Embodiment 1 is used.
Figure 3C:
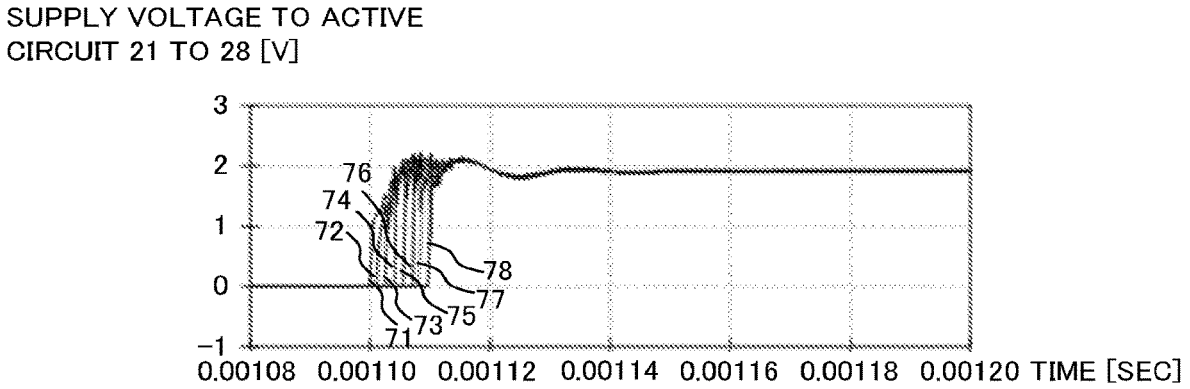
FIG. 3C is a drawing illustrating an example in a temporal change of a supply voltage to each active circuit in a case in which the power supply control method for the APAA device according to Embodiment 1 is used.

In the APAA device 100 according to Embodiment 1, when operations of the active circuits 2 are started, the control circuit 8 causes the switches 31, 32, . . . , 3*n* to be changed from open to closed with predetermined time differences by switching signals. Temporal changes in a switching signal for each switch 3, a power supply current, and a supply voltage to each active circuit in a case in which this power supply control method is used are described with reference to FIGS. 3A, 3B, and 3C. In the examples of FIGS. 3A, 3B, and 3C, n=8.

As illustrated in FIG. 3A, the control circuit 8 sequentially changes switching signals 91 to 98 for the switches 31 to 38 from "0" to "1" with uniform time differences. For example, the control circuit 8 includes a clock, a counter that counts the number of clocks, and a memory that stores a uniform time difference. The control circuit 8 sequentially changes the switching signals 91 to 98 from "0" to "1" every time the counter counts the number of clocks equivalent to the uniform time difference. Thus all the active circuits 2 do not concurrently start operations, but rather the number of the active circuit 2 that start operations increases stepwise. As illustrated in FIG. 3B, the power supply current 6 increases stepwise, and sharp change in the amount of current can be avoided. By such control of the power supply, a transient due to reactance components of the power supply wiring, a transient response characteristic of the power supply circuit, or the like can be mitigated, and distortion and ringing at the rising edge of the power supply voltage can be suppressed, as illustrated in FIG. 3C.

Although the operation of the active circuit 2 at the start is described using FIGS. 3A, 3B, and 3C, distortion and ringing of the power supply voltage may occur at the end of the operation for reasons similar to those of the time of the start since the power supply current sharply decreases in response to the end of operation of the active circuit 2. To address this, distortion and ringing at the falling edge of the power supply voltage can be suppressed by controlling each switch 3 to be sequentially changed from closed to open with a uniform time difference when the operation of the active circuit 2 is ended.

As described above, in the APAA device 100, which distributes and supplies power from the power supply circuit 4 to the active circuits 2, according to Embodiment 1, the control circuit 8 that controls starts and stops of the supply of power to the active circuits 2 sets differences in timings of starting or stopping of supply of power to the active circuits 2. The power supply current thereby increases or decreases stepwise, which can suppress ringing and distortion that may occur at the rising edge and the falling edge of the power supply voltage at the start or the end of the transmission and reception operation, while suppressing size and cost of the device.

Suppressing of the ringing and distortion that may occur at the rising edge and the falling edge of the power supply voltage at the start or the end of the transmission and reception operation can avoid damage to the active circuits. The excessive output current required momentarily in the power supply circuit can be suppressed. In addition, unnecessary spreading of the frequency spectrum of the transmitted wave at the sharp rising and falling edges of the transmission power can be suppressed.

Embodiment 2

The distances between the active circuits 2 and the power supply section of the power supply circuit 4 depend on positions at which the active circuits 2 are mounted on the APAA device 100, and thus among the active circuits 2, an active circuit 2 has a longer distance from the power supply circuit 4 and an active circuit 2 has a shorter distance therefrom. In particular, the difference in the distance would be greater with increased size of the APAA device 100. In Embodiment 1, the control circuit 8 sequentially changes a level of the switching signal for each switch 3 between "0" and "1" with a uniform time difference. In practice, each active circuit 2 starts or ends an operation at a time obtained by adding, to switching time of the switching signal for each switch 3, (i) a propagation delay time due to a wiring length between each active circuit 2 and the power supply circuit 4, and (ii) a delay propagation time of the switching signal due to the wiring length between each active circuit 2 and the control circuit 8. That is, the propagation delay time due to the wiring length between each active circuit 2 and the power supply circuit 4 and the delay propagation time of the switching signal due to the wiring length between each active circuit 2 and the control circuit 8 cause a lag between the timing at which the control circuit 8 switches the level of the switching signal for each switch 3 between "0" and "1" and the timing at which each active circuit 2 actually starts or ends the operation of each active circuit 2.

Thus, in Embodiment 2, the control circuit 8 switches the level of the switching signal for each switch 3 between "0" and "1" at a timing that takes into account the propagation delay time due to the wiring length between each active circuit 2 and the power supply circuit 4 and the propagation delay time of the switching signal due to the wiring length between each active circuit 2 and the control circuit 8 to execute start or end of the operation of each active circuit 2 with a predetermined time difference. The timing at which each active circuit 2 executes start or end of an operation at a predetermined time difference is hereinafter referred to as an execution timing. The timing at which the control circuit 8 switches the level of the switching signal for each switch 3 between "0" and "1" is referred to as a switching timing. The time difference in the execution timings is not limited to the uniform time difference as in Embodiment 1, but rather may be a time difference that can suppress distortion and ringing of the power supply voltage.

The time that is a sum of the propagation delay time due to the wiring length between each active circuit 2 and the power supply circuit 4 and the propagation delay time of the switching signal due to the wiring length between each active circuit 2 and the control circuit 8 is referred to as a delay adjustment time. The delay adjustment time is, for example, predetermined by experimentation executed at the prototype stage when wiring between each active circuit 2 and the power supply circuit 4 and wiring between each active circuit 2 and the control circuit 8 are determined. Alternatively, the delay adjustment time may be determined by conducting simulations.

The control circuit 8 switches the level of the switching signal for each switch 3 between "0" and "1" at the switching timing obtained by subtracting the delay adjustment time from the execution timing. In other words, the control circuit 8 switches the level of the switching signal for each switch 3 between "0" and "1" at the switching timing obtained by advancing the execution timing by the delay adjustment time. The control circuit 8 may acquire information indicating the delay adjustment time from the exterior and calculate the switching timing obtained by subtracting the delay adjustment time from the execution timing.

Alternatively, with a determined execution timing, the control circuit 8 may acquire information indicating the switching timing from the exterior or may pre-store the information. For example, the control circuit 8 includes a clock, a counter that counts the number of clocks, and a memory that stores a time difference of the switch timing. The control circuit 8 sequentially changes the switching signal for each switch 3 from "0" to "1" every time the counter counts the number of clocks equivalent to the time difference of the switching timing.

In the APAA device 100 according to Embodiment 2, the control circuit 8 switches the level of switching signals for switches 31, 32, . . . , 3*n* between "0" and "1" at the switching timings when operations of the antenna elements 1 connected to the active circuits 2 are started. Temporal changes in a switching signal for each switch 3, a power supply current, and a supply voltage for each active circuit in this case are described with reference to FIG. 4.

Figure 4:
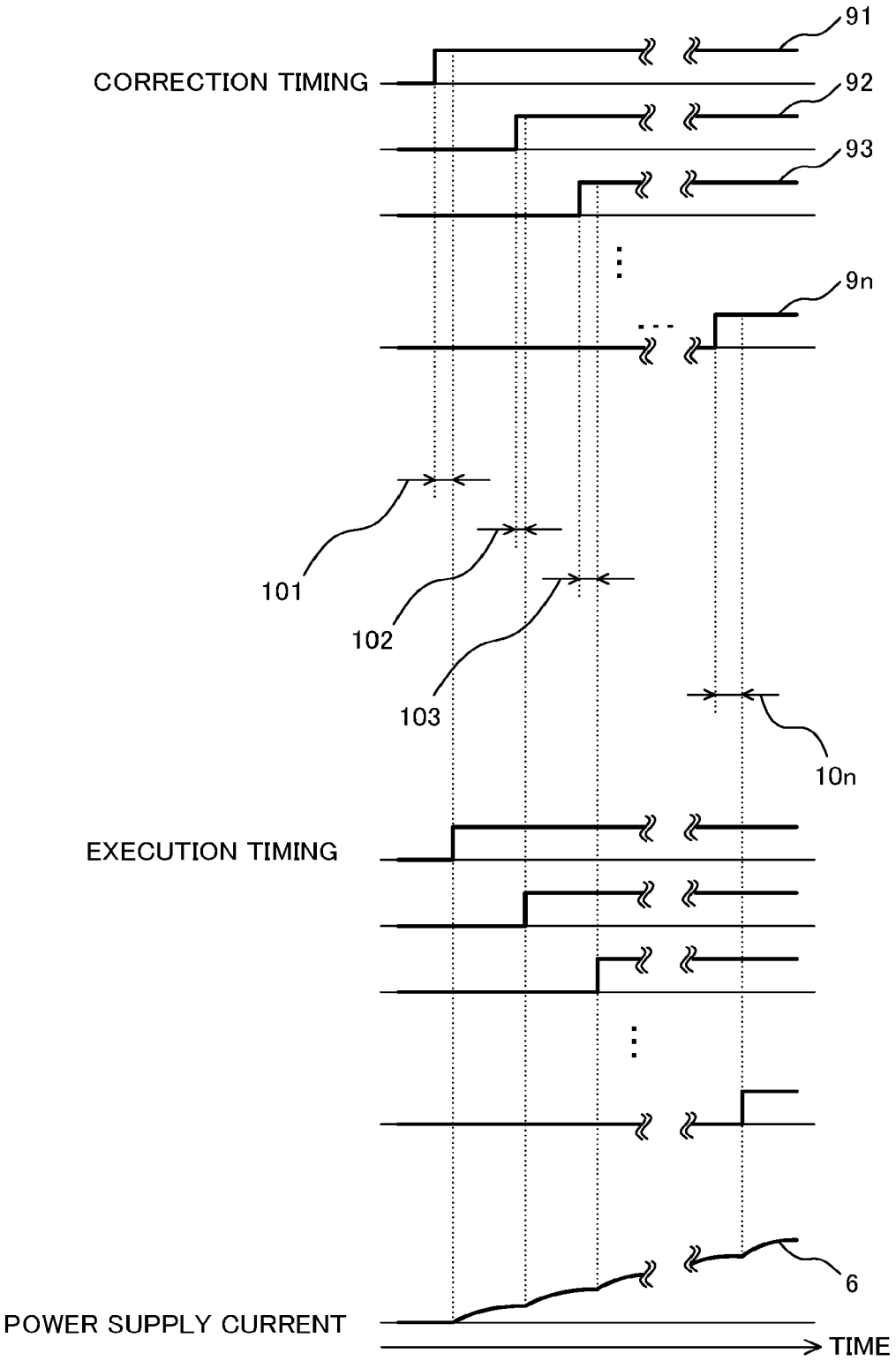
FIG. 4 is a drawing illustrating an example of temporal changes in a switching timing, a delay adjustment time, an execution timing, and a power supply current in a power supply current in a case in which a power supply control method for an APAA device according to Embodiment 2 is used.

As illustrated in FIG. 4, the switching signals 91, 92, . . . , 9*n* for the switches 31, 32, . . . , 3*n* are changed from "0" to "1" at the switching timing obtained by subtracting the delay adjustment times 101, 102, . . . , 10*n* from the corresponding execution timings at which the active circuit 2 each start operations at a predetermined time difference. Changing the switching signal for each switch 3 from "0" to "1" at the switching timing enables each active circuit 2 to start an operation at the execution timing. The number of the active circuits 2 that start operations thereby increases stepwise and the power supply current 6 increases stepwise as well, thus avoiding a sharp change in the amount of current. By such control of the power supply, a transient due to reactance components of the power supply wiring, a transient response characteristic of the power supply circuit, or the like can be mitigated, and distortion and ringing at the rising edge of the power supply voltage can be suppressed.

Although the operation of the active circuit 2 at the start is described using FIG. 4, distortion and ringing of the power supply voltage may occur at end of the operation for reasons similar to those of the time of the start since the power supply current sharply decreases in accompaniment with the end of operation of the active circuit 2. To address this, by changing the level of the switching signals for the switches 31, 32, . . . , 3*n* between "0" and "1" at the switching timings when the operations of the antenna elements 1 connected to the active circuits 2 are ended, the operation of each active circuit 2 can be ended at the execution timing, thereby suppressing distortion and ringing at the falling edge of the power supply voltage.

As described above, in the APAA device 100, which distributes and supplies power from the power supply circuit 4 to the active circuits 2, according to Embodiment 2, the control circuit 8 that controls starts and stops of supply of power to the active circuits 2 sets time differences in timings of start or stop of supply of power to the active circuits 2. The power supply current thereby increases or decreases stepwise, which can suppress ringing and distortion that may occur at the rising edge and the falling edge of the power supply voltage at the start or the end of the transmission and reception operation, while suppressing size and cost of the device.

The switching of the level of the switching signal for each switch 3 between "0" and "1" by the control circuit 8 at the switching timing obtained by subtracting the delay adjustment time from the execution timing can suppress distortion and ringing of the power supply voltage more effectively.

Embodiment 3

Ringing of the power supply voltage is an oscillation having a constant period that is determined by properties of the power supply system. This oscillation gradually becomes attenuated and eventually converges to a predetermined power supply voltage. When the active circuits 2 start or end the operations simultaneously, ringing of the power supply voltage also simultaneously occurs for each active circuit 2. Thus phases of the overshoot and undershoot accompanying the ringing are matched and act to enhance oscillations of each other. This requires the power supply circuit 4 to provide a momentary high output current.

In Embodiment 3, which is made in view of this point, the active circuits 2 are separated into two or more groups, and timings of start or stop of operations of each group of active circuits 2 are set with time differences such that oscillations cancel each other in accordance with ringing periods of the power supply voltage. The number of the active circuits 2 included in a single group may be any number, provided that each group includes one or more active circuits 2.

The timings of start or stop of operations of each group of active circuits 2 that are set with time differences such that oscillations cancel each other in accordance with ringing periods of the power supply voltage are referred to as a group execution timing. The time difference at which oscillations cancel each other in accordance with the ringing periods of the power supply voltage is, for example, a time difference that corresponds to half the ringing period of the power supply voltage. The ringing period of the power supply voltage is, for example, predetermined by experimentation executed at the prototype stage when wiring between each active circuit 2 and the power supply circuit 4 is determined. Alternatively, the ringing period of the power supply voltage may be determined by conducting simulations. For example, the control circuit 8 includes a clock, a counter that counts the number of clocks, and a memory that stores a time difference of the group execution timing. The control circuit 8 sequentially changes the switching signals for switches 3 from "0" to "1" every time the counter counts the number of clocks equivalent to the time difference of the group execution timing.

Figure 5A:
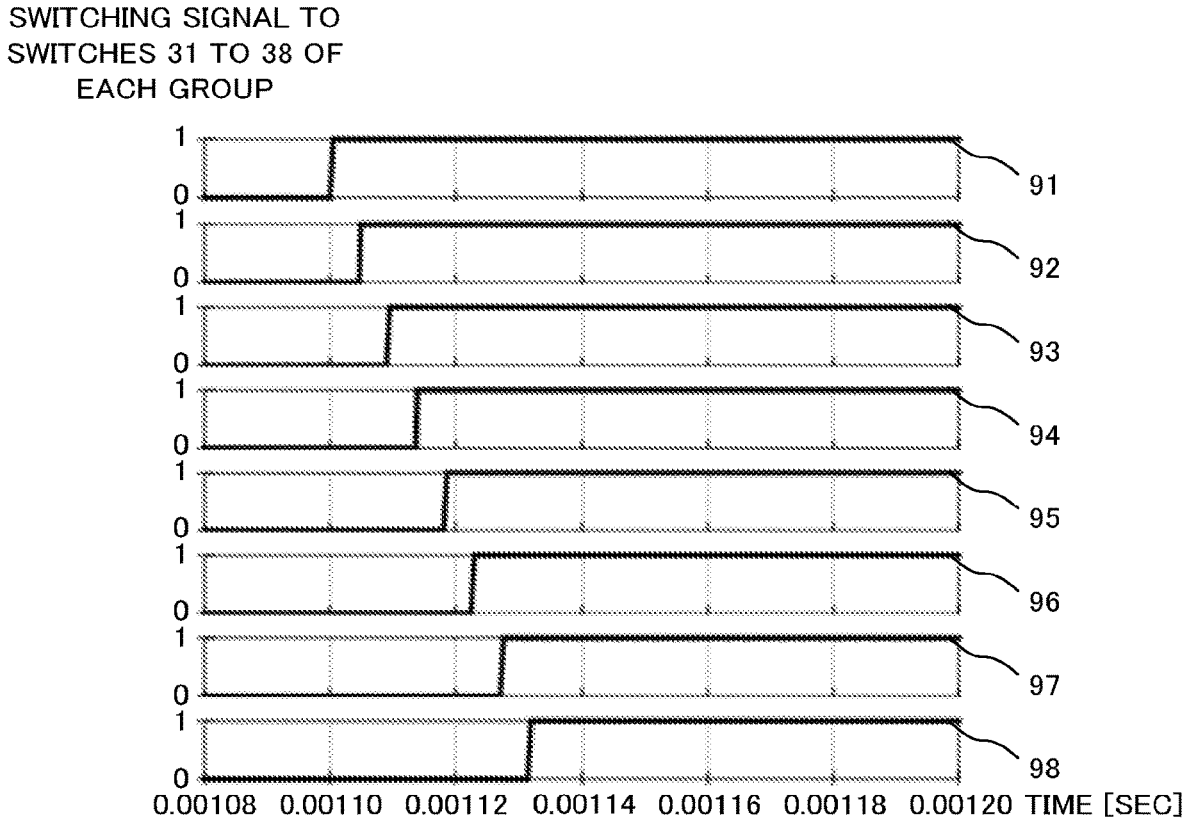
FIG. 5A is a drawing illustrating an example of a temporal change in a switching signal to each switch in a case in which a power supply control method for an APAA device according to Embodiment 3 is used.
Figure 5B:
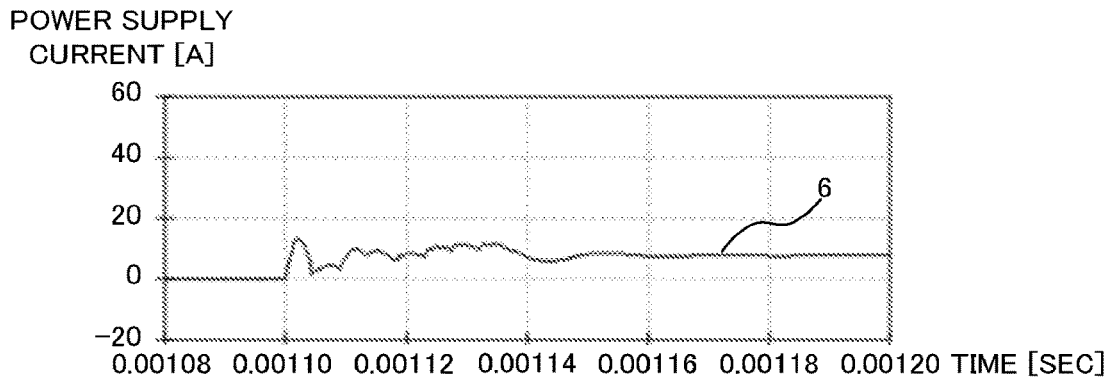
FIG. 5B is a drawing illustrating an example of a temporal change in a power supply current in a case in which the power supply control method for the APAA device according to Embodiment 3 is used.
Figure 5C:
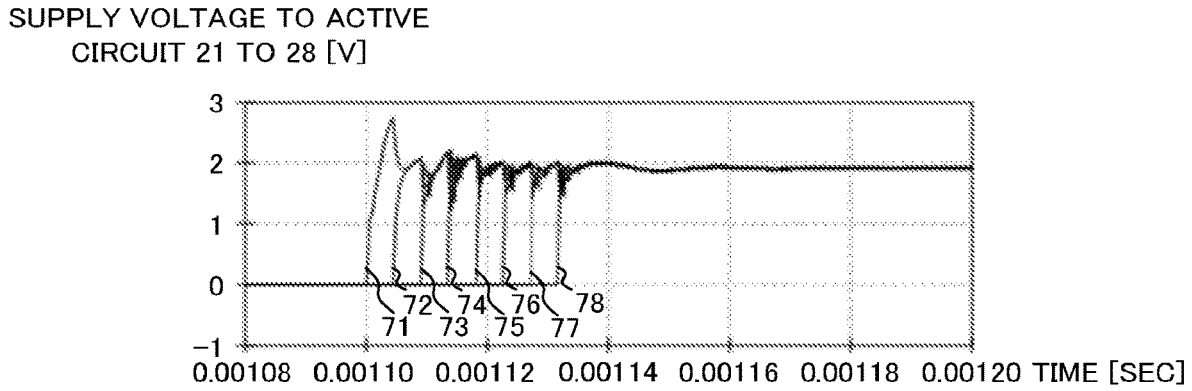
FIG. 5C is a drawing illustrating an example of a temporal change in a supply voltage to each active circuit in which the power supply control method for the APAA device according to Embodiment 3 is used.

In the APAA device 100 according to Embodiment 3, the switch 3 corresponding to each group of active circuits 2 is changed from open to closed at the group execution timing. Temporal changes in switching signals for each group of switches 3, a power supply current, and supply voltage for each active circuit in this case are described with reference to FIGS. 5A, 5B, and 5C. In the examples of FIGS. 5A, 5B, and 5C, n=8.

As illustrated in FIG. 5A, all the active circuits 2 do not simultaneously start operations but rather the number of the active circuits 2 that start operations is increased stepwise by setting time differences in the timings of changing the switches 31 to 38 from open to closed, that is, timings at which the control circuit 8 changes the switching signals 91 to 98 for the corresponding switches 3 from "0" to "1", such that the oscillations cancel each other in accordance with the ringing periods of the power supply voltage. As illustrated in FIG. 5B, the power supply current 6 thus increases stepwise, and a sharp change in the amount of current can be avoided.

By such control of the power supply, ringing of the power supply voltage occurring in each group at start or end of operations of the active circuits 2 act in directions such that the ringing of groups cancel each other, and distortion and ringing at the rising edge of the power supply voltage can be suppressed, as illustrated in FIG. 5C.

Figure 6:
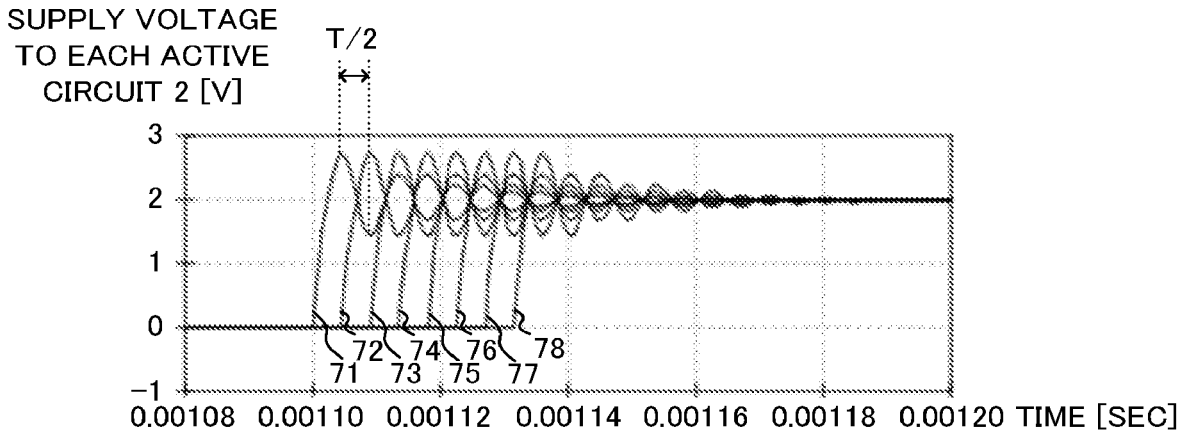
FIG. 6 is a drawing for description of a relationship between a frequency of ringing of the power supply voltage and opening/closing of each switch in a case of using the power supply control method for the APAA device according to Embodiment 3.

A relationship between the ringing period of the power supply voltage and the opening and closing of each switch is described using FIG. 6. FIG. 6 is a graph plotting and overlaying temporal changes in the supply voltages in the active circuits 2 occurring at start of operations of the active circuits 2 upon reception of the switching signals by the corresponding switches 3 with a time difference that is a half period of the ringing of the power supply voltage. In the example of FIG. 6, n=8, and T represents a ringing period. As illustrated in FIG. 6, when the operations of the active circuits 2 are started one by one with a time difference that is a half period of the ringing of the power supply voltage, phases in overshoot and undershoot accompanying ringing of the power supply voltage occurring in adjoining active circuits 2 are mutually opposite, thus acting such that oscillations cancel each other.

Although the operation of the active circuit 2 at the start is described using FIGS. 5A to 5C and 6, ringing of the power supply voltage may occur at end of the operation for reasons similar to those of the time of the start since the power supply current sharply decreases in accompaniment with the end of operation of the active circuit 2. To address this, ringing at the falling edge of the power supply voltage can be suppressed by changing each switch 3 from closed to open with the time difference at which oscillations cancel each other in accordance with the ringing of the power supply voltage when the operations of the antenna elements 1 connected to the active circuits 2 end.

As described above, in the APAA device 100 that distributes and supplies power from the power supply circuit 4 to the active circuits 2, according to Embodiment 3, the control circuit 8 that controls starts and stops of supply of power to the active circuits 2 sets differences in timings of start or stop of supply of power to the active circuits 2. The power supply current thereby increases or decreases stepwise, which can suppress ringing and distortion that may occur at the rising edge and the falling edge of the power supply voltage at the start or the end of the transmission and reception operation, while suppressing size and cost of the device.

Ringing of the power supply voltage can be suppressed more effectively by setting time differences such that oscillations cancel each other in accordance with ringing periods of the power supply voltage to open or stop operations of each group of the active circuits 2.

Embodiment 4

If active circuits 2 simultaneously start or stop operations when the APAA device 100 starts or stops a transmission operation, a drastic change in the transmission power causes a phenomenon in which a frequency spectrum of the transmitted wave momentarily broadens. When such a phenomenon is prominent, the frequency spectrum of the transmitted wave spreading out of a predetermined transmission frequency band may exceed an allowable power density, which may adversely affect other systems.

In the APAA devices 100 according to Embodiments 1 to 3, the number of the active circuits 2 that execute transmission operations increases or decreases stepwise by setting time differences in the timings of start or stop of the transmission operation of each active circuit 2. Since the transmission power of the whole APAA device 100 is a sum of transmission power of the individual active circuits 2, the transmission power of the whole APAA device 100 also increases or decreases stepwise as the number of the active circuits 2 that execute the transmission operations increases or decreases stepwise. Such operation enables suppression of the spreading of the frequency spectrum of the transmitted wave resulting from a change in the transmission power of the whole APAA device 100.

In addition, a drastic change in waveform in the time domain is known to lead to momentary spreading of the spectrum in the frequency domain. Means for multiplying the waveform of the time domain with a window function is well known as means for suppressing the spreading.

In Embodiment 4, which is made in view of this point, the timings of start or stop of operations of each group of active circuits 2 are set with time differences such that the change in the time domain of the transmission power of the whole APAA device 100 has a form following the window function. Such operation enables more effective suppression of spreading of the frequency spectrum of the transmitted wave resulting from the change in the transmission power. The timing of start or stop of an operation of each active circuit 2 such that the change in the time domain of the transmission power of the whole APAA device 100 follows the window function is referred to as window function execution timing. There are many kinds of window functions, for example, a Hanning window and a Hamming window. The window function execution timing is, for example, predetermined by experimentation executed at the prototype stage when wiring between each active circuit 2 and the power supply circuit 4 is determined. Alternatively, the window function execution timing may be determined by conducting simulations. For example, the control circuit 8 includes a clock, a counter that counts the number of clocks, and a memory that stores a time difference of the window function execution timing. The control circuit 8 sequentially changes the switching signal for each switch 3 from "0" to "1" every time the counter counts the number of clocks equivalent to the time difference of the window function execution timing.

Figure 7:
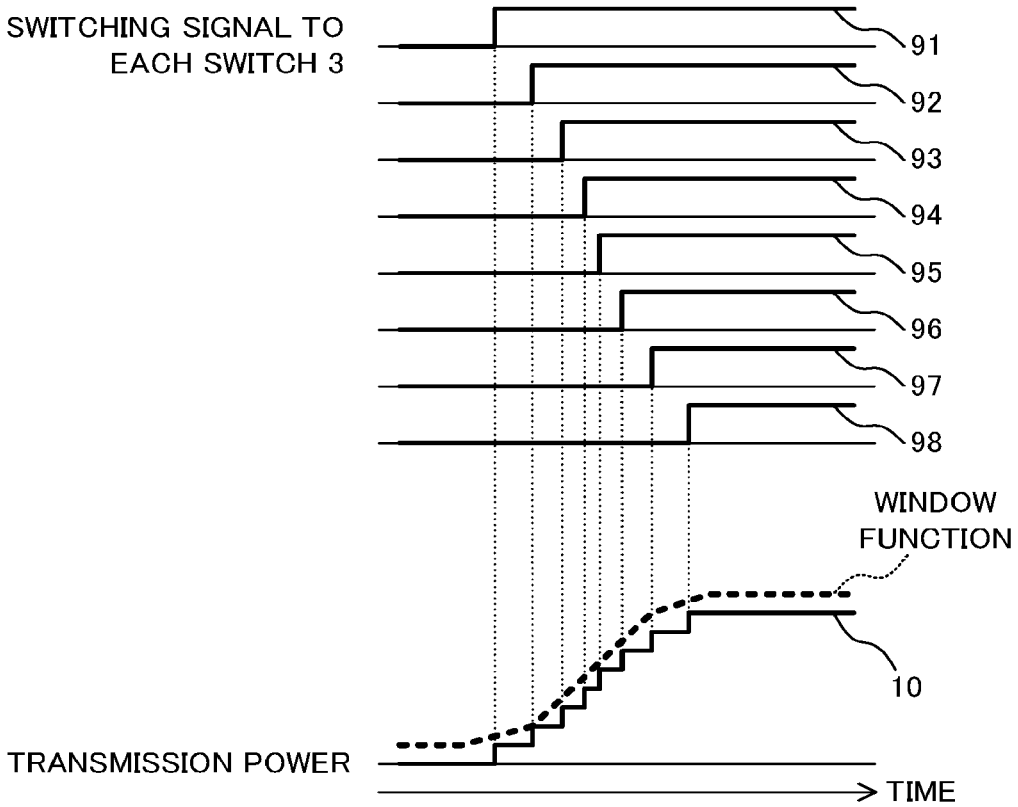
FIG. 7 is a drawing illustrating an example of a temporal change in a switching signal for each switch and transmission power in a case in which a power supply control method for an APAA device according to Embodiment 4 is used.

In the APAA device 100 according to Embodiment 4, the switch 3 corresponding to each active circuit 2 is changed from open to closed at the window function execution timing. Temporal changes in a switching signal for each switch 3 and transmission power of the whole APAA device 100 in this case are described using FIG. 7. In the example of FIG. 7, n=8.

As illustrated in FIG. 7, timings of changing switches 31 to 38 from open to closed, that is, timings at which the control circuit 8 changes the switching signals 91 to 98 for the corresponding switches 3 from "0" to "1", are set with time differences such that the change in the time domain of the transmission power 10 of the whole APAA device 100 has a form following the window function. Such operations enables suppression of spreading of the frequency spectrum of the transmitted wave resulting from a change in the transmission power 10 of the whole APAA device 100.

Although the operation of the active circuit 2 at the start is described using FIG. 7, a phenomenon in which a frequency spectrum of the transmitted wave momentarily broadens may also occur at the end of the operation. To address this, spreading of the frequency spectrum of the transmitted wave resulting from a change in the transmission power 10 of the whole APAA device 100 can be suppressed more effectively by changing each switch 3 from closed to open at the window function execution timing when the operations of the antenna elements 1 connected to the active circuits 2 end.

As described above, in the APAA device 100, which distributes and supplies power from the power supply circuit 4 to the active circuits 2, according to Embodiment 4, the control circuit 8 that controls starts and stops of supply of power to the active circuits 2 sets time differences in timings of start or stop of supply of power to the active circuits 2. The power supply current thereby increases or decreases stepwise, which can suppress ringing and distortion that may occur at the rising edge and the falling edge of the power supply voltage at the start or the end of the transmission and reception operation, while suppressing size and cost of the device.

Spreading of the frequency spectrum of the transmitted wave can be suppressed more effectively by setting time differences in the timings at the time of start of stop of the transmission operation of the APAA device such that the change in the time domain of the transmission power of the whole APAA device 100 has a form following the window function to open or stop an operation of each active circuit 2.

Embodiment 5

In Embodiment 5, the time differences in the timings of start or stop of operations of the active circuits 2 are set to a uniform time difference, and the number of the active circuits 2 that start or stop at each timing is adjusted, thereby providing a change in the time domain of a sum of transmission power with a characteristic such that the change follows the window function. The number of the active circuits 2 that start or stop an operation at each timing with a uniform time difference to provide the change in the time domain of the sum of the transmission power with the characteristic such that the change follows the window function is, for example, predetermined by experimentation executed at the prototype stage when wiring between each active circuit 2 and the power supply circuit 4 is determined. Alternatively, the number of the active circuits 2 that start or stop an operation at each timing with a uniform time difference may be determined by conducting simulations. For example, the control circuit 8 includes a clock, a counter that counts the number of clocks, and a memory that stores the number of the active circuits 2 that start or stop the operation at each timing with a uniform time difference. The control circuit 8 changes the switching signals for the switches 3, the number of which is the number of the active circuits 2 that start or stop the operation at each timing, from "0" to "1" every time the counter counts the number of clocks equivalent to the uniform time difference.

Figure 8:
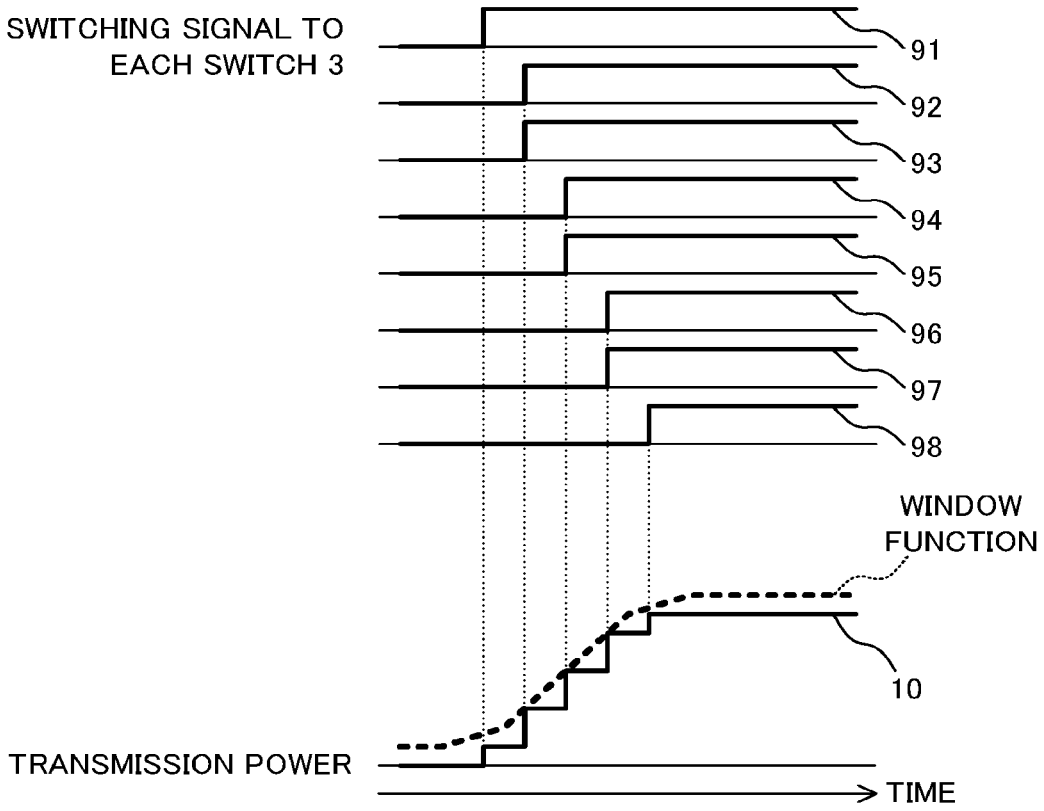
FIG. 8 is a drawing illustrating an example of a temporal change in a switching signal for each switch and transmission power in a case in which a power supply control method for an APAA device according to Embodiment 5 is used.

In the APAA device 100 according to Embodiment 5, switches 3 corresponding to active circuits 2, the number of which is the number of active circuits 2 grouped such that a change in the time domain of transmission power of the whole APAA device 100 follows the window function, are turned on and off with a uniform time difference at the open or stop of operations of the active circuits 2. Temporal changes in a switching signal for each switch 3 at the time of start of an operation of the active circuit 2 and transmission power of the whole APAA device 100 are described using FIG. 8. In the example of FIG. 8, n=8.

As illustrated in FIG. 8, the timings of changing the switches 3 from open to closed are uniform. The control circuit 8 adjusts the number of the switches 3 that receive the switching signals at each timing, and a change in the time domain of the transmission power 10 of the whole APAA device 100 follows the window function. In the example of FIG. 8, the control circuit 8 concurrently changes switching signals 92 and 93 from "0" to "1", concurrently changes switching signals 94 and 95 from "0" to "1", and concurrently changes switching signals 96 and 97 from "0" to "1", and a change in the time domain of transmission power 10 of the whole APAA device 100 follows the window function. Such operation enables more effective suppression of spreading of the frequency spectrum of the transmitted wave resulting from a change in the transmission power 10 of the whole APAA device 100.

Although the operation of the active circuit 2 at the start is described using FIG. 8, a phenomenon in which a frequency spectrum of the transmitted wave momentarily spreads may occur at end of the operation. To address this, when the operations of the antenna elements 1 connected to the active circuits 2 end, time differences of timings of start or stop of operations of the active circuits 2 are set with a uniform time difference, and the number of the active circuits 2 that start or stop a transmission operation at each timing is adjusted, thereby providing a change in the time domain of a sum of transmission power with a characteristic such that the change follows the window function. Such operation enables suppression of spreading of the frequency spectrum of the transmitted wave resulting from a change in the transmission power of the whole APAA device 100.

As described above, in the APAA device 100, which distributes and supplies power from the power supply circuit 4 to the active circuits 2, according to Embodiment 5, the control circuit 8 that controls starts and stops of supply of power to the active circuits 2 sets time differences in timings of start or stop of supply of power to the active circuits 2. The power supply current thereby increases or decreases stepwise, which can suppress ringing and distortion that may occur at the rising edge and the falling edge of the power supply voltage at the start or the end of the transmission and reception operation, while suppressing size and cost of the device.

At start or stop of transmission operation of the APAA device 100, time differences set in timings of start or stop of operations of the active circuits 2 are set to a uniform time difference, and the number of the active circuits 2 that start or stop an transmission operation at each timing is adjusted, thereby providing a change in the time domain of a sum of transmission power with a characteristic such that the change follows the window function. Such operation enables move effective suppression of spreading of the frequency spectrum of the transmitted wave.

Embodiment 6

In Embodiments 1 to 5, the APAA device 100 includes the active circuits 2 and the switches 3 in parallel. In Embodiment 6, The APAA device 100 includes semiconductor integrated circuits. Active circuits 2 and switches 3 of the APAA device 100 are grouped into sets of two or more lines, and each set of two or more lines of active circuits 2 and switches 3 is included in the corresponding semiconductor integrated circuit.

Figure 9:
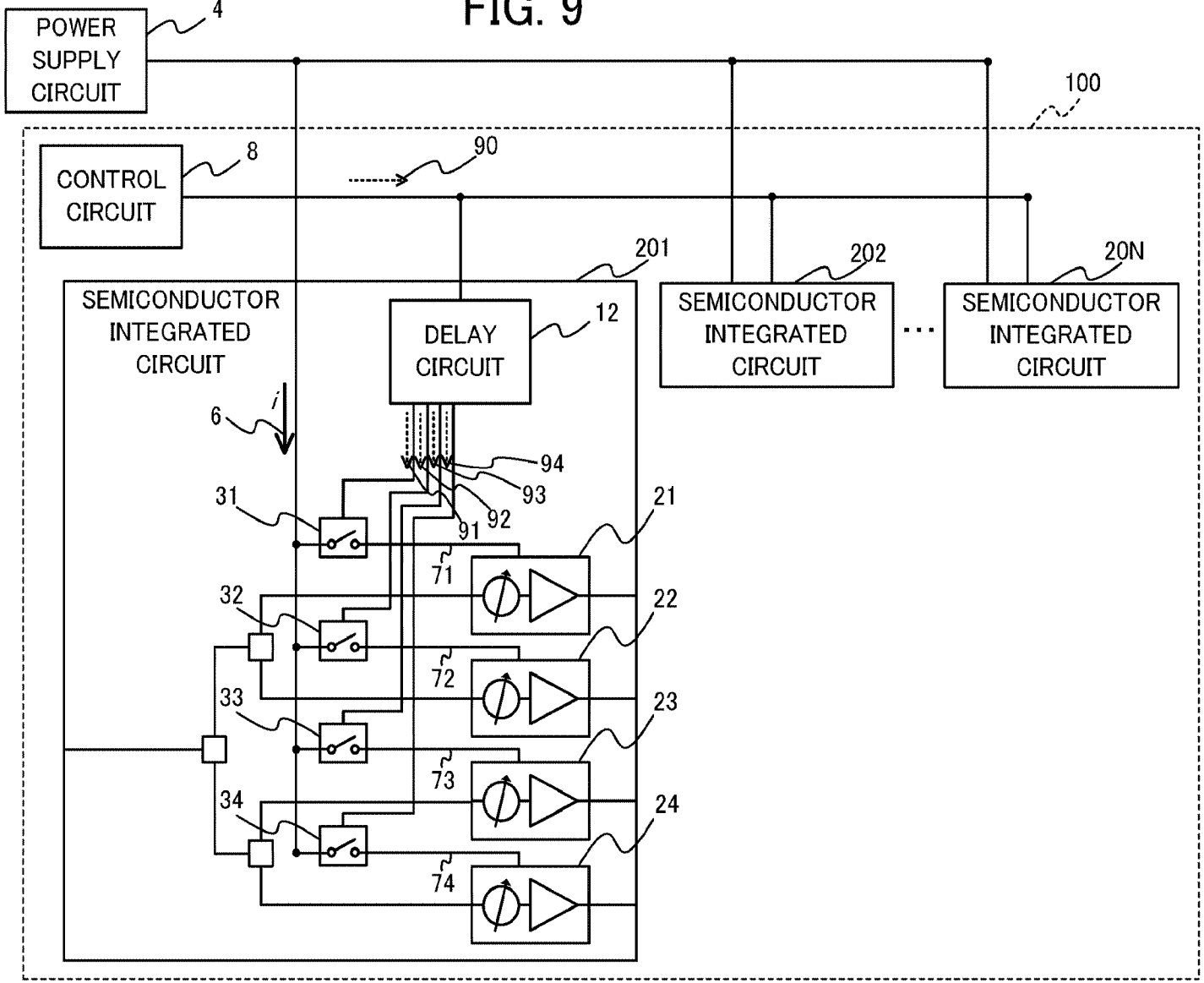
FIG. 9 is a drawing illustrating an example configuration of an APAA device according to Embodiment 6.

FIG. 9 is a drawing illustrating an example configuration of an APAA device 100 according to Embodiment 6. In the example of FIG. 9, the APAA device 100 includes N semiconductor integrated circuits 201, 202, . . . , 20N, each including a set of four lines of the active circuits 2 and the switches 3. The semiconductor integrated circuits 201, 202, . . . , 20N may be collectively referred to as semiconductor integrated circuits 20. N is 1 or more. In FIG. 9, illustration of the antenna elements 1 is omitted.

The semiconductor integrated circuit 201 also includes a delay circuit 12 that sets time differences in timings of start or stop of operations for the active circuits 2 included therein. Power supplied from the power supply circuit 4 is distributed to each semiconductor integrated circuit 20. The power distributed to the semiconductor integrated circuits 201 is distributed to each active circuit 2. The control circuit 8 outside the semiconductor integrated circuits 20 transmits a switching signal 90 for a switch 3 to a delay circuit 12 of each semiconductor integrated circuit 20. The delay circuit 12 of the semiconductor integrated circuit 201 transmits switching signals 91 to 94 to the corresponding switches 31 to 34 while receiving the switching signal 90 from the control circuit 8. The delay circuit 12 changes the level of the switching signals 91 to 94 between "0" and "1" at a predetermined time difference upon change of the level of the switching signal 90 between "0" and "1". The configuration of the semiconductor integrated circuits 202 to 20N is similar to that of the semiconductor integrated circuit 201.

This enables suppressing of distortion and ringing at the rising edge or the falling edge of the power supply voltage for each semiconductor integrated circuit 20. In addition, the control circuit 8 may transmit the switching signal 90 for each semiconductor integrated circuit 20 to switch the level of the switching signal 90 between "0" and "1", thereby enabling reduction in the number of switching of the level of the start signal between "0" and "1" by the control circuit 8. This can simplify wiring and reduce loads of the control circuit 8.

As described above, in the APAA device 100, which distributes and supplies power from the power supply circuit 4 to the active circuits 2, according to Embodiment 6, the control circuit 8 that controls starts and stops of supply of power to the active circuits 2 sets time differences in timing of start or stop of supply of power to the active circuits 2. The power supply current thereby increases or decreases stepwise, which can suppress ringing and distortion that may occur at the rising edge and the falling edge of the power supply voltage at the start or the end of the transmission and reception operation, while suppressing size and cost of the device.

Inclusion of the delay circuit 12 together with a certain number of active circuits 2 and switches 3 in a single semiconductor integrated circuit 20 can simplify wiring and reduce loads of the control circuit 8.

In the aforementioned Embodiments 1 to 6, the number of the antenna elements 1 connected to a single active circuits 2 is one, but such configuration is not limiting. The number of the antenna elements 1 connected to the single active circuit 2 may be two or more.

The aforementioned Embodiments 1 to 6 are described separately but these embodiments may be combined.

In the aforementioned Embodiment 3, a time difference that corresponds to half the ringing period of the power supply voltage is used as an example of a time difference at which oscillations cancel each other in accordance with the ringing periods of the power supply voltage. Such configuration is not limiting, and the time difference at which oscillations cancel each other in accordance with the ringing periods of the power supply voltage may be any time difference that allows the phase of the ringing to shift by 180°.

In the aforementioned Embodiments 1 to 6, the control circuit 8 transmits to the switch 3 a square wave switching signal with levels of "1" and "0" represented by high/low in voltage, but the switching signal is not limited thereto. The switching signal may be any signal that can control opening and closing of the switch 3.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

1, 11 to 1*n* Antenna element
2, 21 to 2*n* Active circuit
3, 31 to 3*n* Switch
4 Power supply circuit
6 Power supply current
8 Control circuit
10 Transmission power
20, 201 to 20N Semiconductor integrated circuit
12 Delay circuit
71 to 7*n* Voltage
90 to 9*n* Switching signal
100 APAA device
101 to 10*n* Delay adjusting time

What is claimed is:

1. An active phased array antenna device, comprising:
antenna elements to transmit and receive radio waves;
active circuits connected to the antenna elements and configured to start an operation upon supply of power distributed from a power supply circuit and transmit and receive signals via the antenna elements to which the active circuits are connected;
switches connected to the active circuits and configured to start, upon being closed, supply of power to the active circuits to which the switches are connected, and stop, upon being opened, the supply of power to the active circuits to which the switches are connected; and
a control circuit to transmit, to the switches, switching signals to turn the switches on and off to control starting and stopping of the supply of power to the active circuits, wherein
the control circuit is configured to set a time difference between execution timings of executing the starting of the supply of power to a plurality of the active circuits, or set a time difference between execution timings of executing the stopping of the supply of power to the plurality of the active circuits, and
the control circuit is configured to change open/closed states of the switching signals to be transmitted to the switches, at a switching timing obtained by subtracting, from the execution timing, a delay adjustment time that is a sum of (i) a propagation delay time due to a wiring length between each active circuit and a power supply section of the power supply circuit and (ii) a propagation delay time of the switching signal due to the wiring length between each active circuit and the control circuit.

2. An active phased array antenna device, comprising:
antenna elements to transmit and receive radio waves;
active circuits connected to the antenna elements and configured to start an operation upon supply of power distributed from a power supply circuit and transmit and receive signals via the antenna elements to which the active circuits are connected;

switches connected to the active circuits and configured to start, upon being closed, supply of power to the active circuits to which the switches are connected, and stop, upon being opened, the supply of power to the active circuits to which the switches are connected; and a control circuit to transmit, to the switches, switching signals to turn the switches on and off to control starting and stopping of the supply of power to the active circuits, wherein the control circuit is configured to set a time difference between execution timings of executing the starting of the supply of power to a plurality of the active circuits, or set a time difference between execution timings of executing the stopping of the supply of power to the plurality of the active circuits, and the control circuit is configured to change, for each group including one or more of the active circuits, open/closed states of the switching signals to be transmitted to the switches by setting time differences in the execution timings such that oscillations cancel each other in accordance with a ringing period of a power supply voltage.

3. The active phased array antenna device according to claim 1, wherein the control circuit is configured to change, for each group including one or more of the active circuits, the open/closed states of the switching signals to be transmitted to the switches by setting time differences in the execution timings such that oscillations cancel each other in accordance with a ringing period of a power supply voltage.

4. An active phased array antenna device, comprising:

antenna elements to transmit and receive radio waves;

active circuits connected to the antenna elements and configured to start an operation upon supply of power distributed from a power supply circuit and transmit and receive signals via the antenna elements to which the active circuits are connected;

switches connected to the active circuits and configured to start, upon being closed, supply of power to the active circuits to which the switches are connected, and stop, upon being opened, the supply of power to the active circuits to which the switches are connected; and a control circuit to transmit, to the switches, switching signals to turn the switches on and off to control starting and stopping of the supply of power to the active circuits, wherein the control circuit is configured to set a time difference between execution timings of executing the starting of the supply of power to a plurality of the active circuits, or set a time difference between execution timings of executing the stopping of the supply of power to the plurality of the active circuits, and the control circuit is configured to change, for each active circuit, open/closed states of the switching signal to be transmitted to the switch by setting timing differences in the execution timings such that a change in a time domain of transmission power of the whole active phased array antenna device follows a window function.

5. The active phased array antenna device according to claim 1, wherein the control circuit is configured to change, for each active circuit, the open/closed states of the switching signal to be transmitted to the switch by setting timing differences in the execution timings such that a change in a time domain of transmission power of a whole the active phased array antenna device follows a window function.

6. An active phased array antenna device, comprising:

antenna elements to transmit and receive radio waves;

active circuits connected to the antenna elements and configured to start an operation upon supply of power distributed from a power supply circuit and transmit and receive signals via the antenna elements to which the active circuits are connected;

switches connected to the active circuits and configured to start, upon being closed, supply of power to the active circuits to which the switches are connected, and stop, upon being opened, the supply of power to the active circuits to which the switches are connected; and a control circuit to transmit, to the switches, switching signals to turn the switches on and off to control starting and stopping of the supply of power to the active circuits, wherein the control circuit is configured to set a time difference between execution timings of executing the starting of the supply of power to a plurality of the active circuits, or set a time difference between execution timings of executing the stopping of the supply of power to the plurality of the active circuits, and the control circuit is configured to change open/closed states of the switching signal to be transmitted to the switch, for each set of active circuits grouped such that a change in a time domain of transmission power of the whole active phased array antenna device follows a window function at start or end of transmission operations of the active circuits by setting a uniform time difference to the execution timings.

7. The active phased array antenna device according to claim 1, wherein the control circuit is configured to change the open/closed states of the switching signal to be transmitted to the switch, for each set of active circuits grouped such that a change in a time domain of transmission power of a whole active phased array antenna device follows a window function at start or end of transmission operations of the active circuits by setting a uniform time difference to the execution timings.

8. An active phased array antenna device, comprising:

antenna elements to transmit and receive radio waves;

active circuits connected to the antenna elements and configured to start an operation upon supply of power distributed from a power supply circuit and transmit and receive signals via the antenna elements to which the active circuits are connected;

switches connected to the active circuits and configured to start, upon being closed, supply of power to the active circuits to which the switches are connected, and stop, upon being opened, the supply of power to the active circuits to which the switches are connected;

a control circuit to transmit, to the switches, switching signals to turn the switches on and off to control starting and stopping of the supply of power to the active circuits; and a semiconductor integrated circuit that includes (i) two or more lines of active circuits and switches among the active circuits and the switches and (ii) a delay circuit to transmit, with a time difference, the switching signal received from the control circuit to the switch to which the delay circuit is connected, wherein the control circuit is configured to set a time difference between execution timings of executing the starting of the supply of power to a plurality of the active circuits, or set a time difference between execution timings of executing the stopping of the supply of power to the plurality of the active circuits, and the control circuit is configured to set time differences in the execution timings by transmitting the switching signal to the delay circuit for the switches.

9. The active phased array antenna device according to claim 1, further comprising:

a semiconductor integrated circuit that includes (i) two or more lines of active circuits and switches among the active circuits and the switches and (ii) a delay circuit to transmit, with a time difference, the switching signal received from the control circuit to the switch to which the delay circuit is connected, wherein the control circuit is configured to set time differences in the execution timings by transmitting the switching signal to the delay circuit for the switches.

10. The active phased array antenna device according to claim 2, further comprising:

a semiconductor integrated circuit that includes (i) two or more lines of active circuits and switches among the active circuits and the switches and (ii) a delay circuit to transmit, with a time difference, the switching signal received from the control circuit to the switch to which the delay circuit is connected, wherein the control circuit is configured to set time differences in the execution timings by transmitting the switching signal to the delay circuit for the switches.

11. The active phased array antenna device according to claim 3, further comprising:

a semiconductor integrated circuit that includes (i) two or more lines of active circuits and switches among the active circuits and the switches and (ii) a delay circuit to transmit, with a time difference, the switching signal received from the control circuit to the switch to which the delay circuit is connected, wherein the control circuit is configured to set time differences in the execution timings by transmitting the switching signal to the delay circuit for the switches.

12. The active phased array antenna device according to claim 4, further comprising:

a semiconductor integrated circuit that includes (i) two or more lines of active circuits and switches among the active circuits and the switches and (ii) a delay circuit to transmit, with a time difference, the switching signal received from the control circuit to the switch to which the delay circuit is connected, wherein the control circuit is configured to set time differences in the execution timings by transmitting the switching signal to the delay circuit for the switches.

13. A power supply control method for controlling supply of power to active circuits that are connected to antenna elements that transmit and receive radio waves, the active circuits transmitting and receiving signals via the antenna elements, the active circuits and the antenna elements being included in an active phased array antenna device, the method comprising:

setting time differences between execution timings of executing start of the supply of power to a plurality of the active circuits, or between execution timings of executing stop of the supply of power to the plurality of the active circuits, wherein a control circuit is configured to change open/closed states of switching signals to be transmitted to the switches, at a switching timing obtained by subtracting, from the execution timing, a delay adjustment time that is a sum of (i) a propagation delay time due to a wiring length between each active circuit and a power supply section of the power supply circuit and (ii) a propagation delay time of the switching signal due to the wiring length between each active circuit and the control circuit.

* * * * *